US007386247B2

(12) United States Patent
Doi

(10) Patent No.: US 7,386,247 B2
(45) Date of Patent: Jun. 10, 2008

(54) IMAGE FORMING APPARATUS

(75) Inventor: Shigeo Doi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/561,786

(22) Filed: Nov. 20, 2006

(65) Prior Publication Data

US 2007/0122177 A1 May 31, 2007

(30) Foreign Application Priority Data

Nov. 28, 2005 (JP) ..... 2005-342043

(51) Int. Cl.
*G03G 21/20* (2006.01)

(52) U.S. Cl. ..... 399/93; 399/92

(58) Field of Classification Search ..... 399/92, 399/93, 91, 98
See application file for complete search history.

(56) References Cited

U.S. PATENT DOCUMENTS 5,128,110 A * 7/1992 Soga et al. ..... 422/168
5,359,401 A * 10/1994 Uehara et al. ..... 399/67
6,792,226 B2 * 9/2004 Chikano ..... 399/92
6,819,892 B2 * 11/2004 Nakazato et al. ..... 399/93
6,882,809 B2 * 4/2005 Hirose et al. ..... 399/92
7,043,172 B2 * 5/2006 Koshimura et al. ..... 399/99
2007/0009283 A1 * 1/2007 Shirakata et al. ..... 399/92

FOREIGN PATENT DOCUMENTS

JP 10307525 A * 11/1998
JP 2004-240270 8/2004

* cited by examiner

*Primary Examiner*—David M. Gray
*Assistant Examiner*—Kristofferson Service
(74) *Attorney, Agent, or Firm*—Canon USA Inc I.P. Div

(57) ABSTRACT

An image forming apparatus includes an image forming unit, an image heating unit, an air circulating unit, and a filter. The air circulating unit circulates air around the image heating unit. The filter absorbs a volatile organic substance in an air circulation path defined by the air circulating unit.

5 Claims, 10 Drawing Sheets

IMAGE FORMING APPARATUS

BACKGROUND OF THE INVENTION

1. Field of the Invention

The present invention relates to an image forming apparatus, such as a copying machine, a printer, and a facsimile.

2. Description of the Related Art

New recording media have been developed due to market demand. Therefore, there is a desire to use such new recording media in an electrophotographic image forming apparatus.

When such new recording media are used in an electrophotographic image forming apparatus, heat that is applied from a fixing device has no influence on the human body, but a very small amount of volatile-organic-compound-containing gas may be generated.

A proposal for reducing the amount of volatile-organic-compound-containing gas that is discharged out of the image forming apparatus has been made.

Japanese Patent Laid-Open No. 2004-240270 discusses disposing a filter, which absorbs volatile-organic-compound-containing gas, in an exhaust duct of an image forming apparatus.

However, when the filter is disposed in the exhaust duct that exhausts heat of the image forming apparatus as discussed in Japanese Patent Laid-Open No. 2004-240270, the filter causes exhaust back pressure. Therefore, the heat in the image forming apparatus may not be sufficiently exhausted.

In addition, in the above-described example, since the volatile organic compound is removed by passing air through the filter only once, the efficiency with which the volatile organic compound is removed can still be improved.

SUMMARY OF THE INVENTION

The present invention is directed to an image forming apparatus that can increase the efficiency with which a volatile organic substance is removed.

The present invention also provides an image forming apparatus that can reduce scattering of a volatile organic substance around an image heating unit.

According to one aspect of the present invention, an image forming apparatus includes an image forming unit configured to form an image on a recording medium, an image heating unit configured to heat the image on the recording medium, an air circulating unit configured to circulate air around the image heating unit, and a filter that removes a volatile organic substance in an air circulation path defined by the air circulating unit.

Further features of the present invention will become apparent from the following detailed description of an exemplary embodiment with reference to the attached drawings.

DESCRIPTION OF THE EMBODIMENT

An image forming apparatus according to the present invention will hereunder be described in detail with reference to the drawings.

Embodiment (1) Image Forming Device

Figure 1:
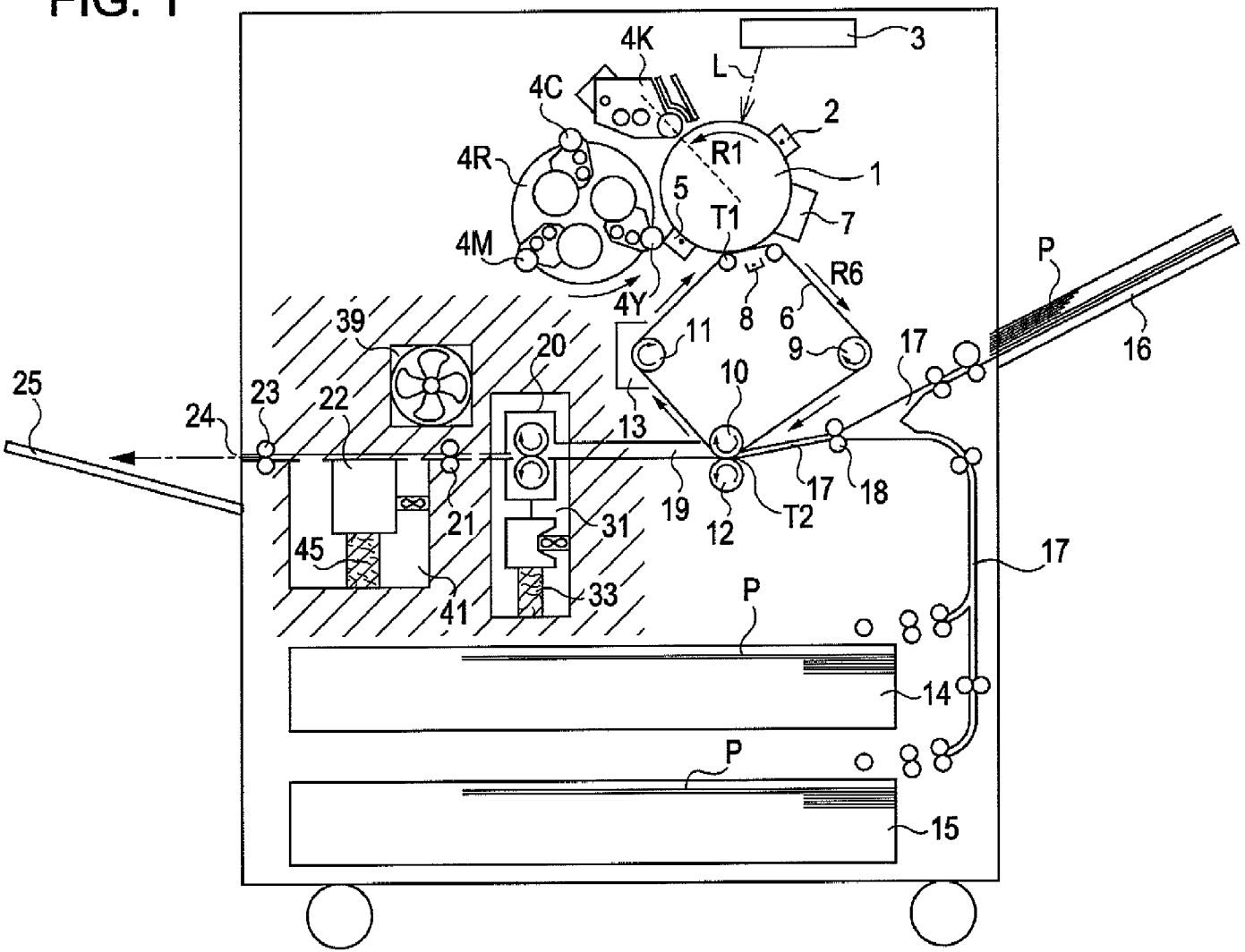
FIG. 1 is a schematic view of an image forming apparatus according to an embodiment.

FIG. 1 is a schematic view of an image forming apparatus according to the present invention. The image forming apparatus is, for example, a four-color, full-color image forming apparatus (such as a printer, a copying machine, or a facsimile) making use of an electrophotographic process. The image forming apparatus includes a rotary-drum-type electrophotographic photosensitive member 1 (hereunder referred to as "drum") serving as an image bearing member. For example, the drum 1 is formed by applying an organic photo conductor (OPC) as an electrophotographic photosensitive layer to the outer peripheral surface of an aluminum cylinder.

The drum 1 is rotationally driven at a predetermined speed counterclockwise in the direction of arrow R1. Then, the surface of the drum 1 is uniformly charged to a predetermined polarity/electrical potential by a corona charger 2 serving as a charging device. Then, the charged surface is exposed to exposure light of image information by an exposing device 3 to form an electrostatic latent image on the surface of the drum in accordance with an exposure pattern. The exposing device 3 in the embodiment can be a laser scanner and outputs laser light L that has been modulated in accordance with the image information input to the image forming apparatus from a host device (not shown) for, for example, a personal computer, a reader scanner, or a facsimile at the other end. By scanning and exposing the uniformly charged surface of the drum 1 with the laser light L, the electrostatic latent image in accordance with the scanning exposure pattern is formed on the surface of the drum. Thereafter, a black developing device 4K, a yellow developing device 4Y, a magenta developing device 4M, or a cyan developing device 4C develops the electrostatic latent image into a toner image.

The black developing device 4K contains black toner as a developer. Movement of the black developing device 4K is controlled between a developable position and a waiting position with respect to the drum 1.

The yellow developing device 4Y contains yellow toner as a developer, the magenta developing device 4M contains magenta toner as a developer, and the cyan developing device 4C contains cyan toner as a developer. These three developing devices 4Y, 4M, and 4C are mounted to a supported rotary member 4R. By controlling the rotation of the rotary member 4R, any one of the developing devices 4Y, 4M, and 4C is selectly moved to its developable position with respect to the drum 1. The electrostatic latent image on the surface of the drum 1 is developed by the developing device that is moved to its developable position.

Reference numeral 6 denotes a flexible endless intermediate transfer belt (hereunder referred to as "belt") formed of a dielectric material. The transfer belt 6 is tightly stretched between and upon a plurality of rollers used for disposing the belt in a tensioned state. A primary transfer nip portion T1 is formed as a result of bringing a portion of the belt 6 into contact with the drum 1. At the primary transfer nip portion T1, a corona charger 8 for primary transfer is provided at the inner side of the belt 6 so as to oppose the drum 1. By rotationally driving a driver roller 9, which is one of the aforementioned plurality of rollers, the belt 6 is rotationally driven at a predetermined speed clockwise in the direction of arrow R6.

Then, a corona charger 5 for removing electrical charge prior to transfer removes the electrical charge of the toner image formed on the surface of the drum 1 to transfer the toner image to the surface of the belt 6 at the primary transfer nip portion T1. In the transfer process, a predetermined bias is applied to the corona charger 8. After the primary transfer of the toner image to the surface of the belt 6, toner remaining on the surface of the drum 1 is removed and cleaned off by a drum cleaner 7 to repeatedly form an image.

In a full-color image-formation mode, a step of forming a toner image on the drum 1 and a step of performing primary transfer of a toner image to the belt 6 are successively executed for component colors for a full-color image, that is, for the four colors, yellow, magenta, cyan, and black. When these steps are executed, multiple transfers of the four-color toner images are performed on the surface of the belt 6 to synthesize and form a full-color toner image that is not fixed. The order in which the colored toner images are formed is not limited to the aforementioned order.

Reference numeral 10 denotes a secondary transfer inner roller, which is one of the aforementioned plurality of rollers. Reference numeral 12 denotes a secondary transfer outer roller that is controlled so as to come into contact with and separate from where the belt 6 is stretched upon the secondary transfer inner roller 10. By bringing the roller 12 into contact with the belt 6, a secondary transfer nip portion (that is, a secondary transfer portion) T2 is formed between them.

Reference numeral 13 denotes a belt cleaner, which is controlled so as to come into contact with and separate from where the belt 6 is stretched upon a tension roller 11, which is one of the aforementioned plurality of rollers.

In repeatedly executing the step of primarily transferring the toner images to the belt 6 from the drum 1, the secondary transfer outer roller 12 and the belt cleaner 13 are kept separated from the belt 6 so as not to adversely affect the toner images that have been primarily transferred to the belt.

In the full-color image-formation mode, the primary transfer of the last color toner image is executed. In synchronism with the synthesization of the unfixed four-color toner images and formation of them on the belt 6, the secondary transfer outer roller 12 is controlled so as to be in a state of contact with the belt 6. This causes the secondary transfer nip portion T2 to be formed. A recording medium (sheet) P that has been separated and fed from a first sheet-feed cassette 14, a second sheet-feed cassette 15, or a manual sheet-feed tray 16 is introduced into the nip portion T2 through a transportation path 17 (including register rollers 18) at a predetermined control timing. The recording medium P is nipped and transported by the secondary transfer nip portion T2, so that the four-color full-color unfixed toner images are secondarily transferred together to the belt 6. In this transfer step, a predetermined secondary transfer bias is applied to a location between the rollers 12 and 10 from a power supply (not shown). The recording medium P leaving the secondary transfer nip portion T2 is separated from the surface of the belt 6 and guided to an after-transfer transportation path 19.

After the secondary transfer, toner remaining on the belt 6 is removed by the belt cleaner 13 to clean the belt 6.

Each of the various devices described above is a structural component of an image forming unit for forming toner images on a recording medium P.

The recording medium P on which the toner images are formed by the image forming unit is introduced into a fixing device 20 serving as an image heating unit. The toner images are heated and pressed along with the recording medium by the fixing device 20. The multiple toner images of the four colors (yellow, magenta, cyan, and black) are fused and mixed to permanently fix the resulting toner image as a full-color print image to the surface of the recording medium P.

The recording medium P leaving the fixing device 20 is transported to first sheet-discharge rollers 21, a sheet-discharge transportation path 22, second sheet-discharge rollers 23, and a sheet-discharge opening 24, so that the recording medium P is discharged onto a sheet-discharge tray 25 disposed at the exterior portion of the image forming apparatus.

In a monochromatic image formation mode, only the black toner image is formed on the drum 1. Then, primary transfer of the black toner image is performed on the belt 6, and secondary transfer of the black toner image is performed on the recording medium P, to introduce the recording medium into the fixing device 20.

(2) Structure of Processing Volatile Organic Substance

In the above-described image forming apparatus, when the fixing device 20 permanently fixes the unfixed toner image formed on the recording sheet P, a very small amount of gas containing a volatile organic substance and not affecting the human body may be generated from new types of recording media among various recording media. The gas containing a volatile organic substance is hereunder referred to as "VOC gas."

The fixing device 20, which is a component in the image forming apparatus where the VOC gas is generated, is covered with a housing 31 (hermetically sealing member) excluding portions of the fixing device 20 where a recording medium moves into and out of the fixing device 20, so that the fixing device 20 is in a substantially hermetically sealed state. That is, the housing 31 is provided so as to substantially hermetically seal the fixing device 20 while allowing the recording medium to move into and out of the fixing device 20. An air circulating unit for circulating air in the housing 31 is provided. A filter that absorbs the VOC gas in the air is provided in an air circulation path.

Figure 2A:
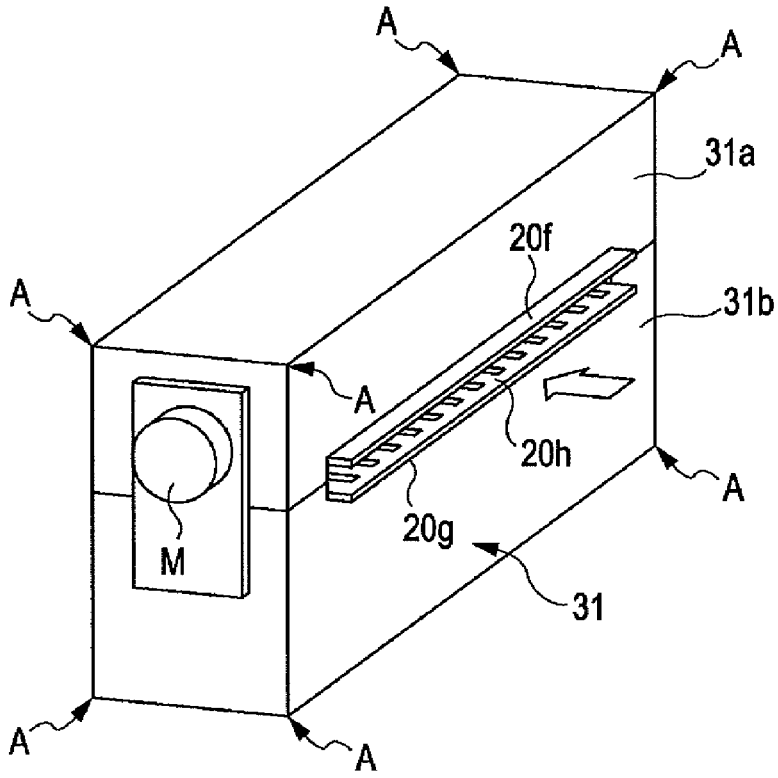
FIG. 2A is an external perspective view of a housing of a fixing device as seen from a recording-medium-entering-opening side.
Figure 2B:
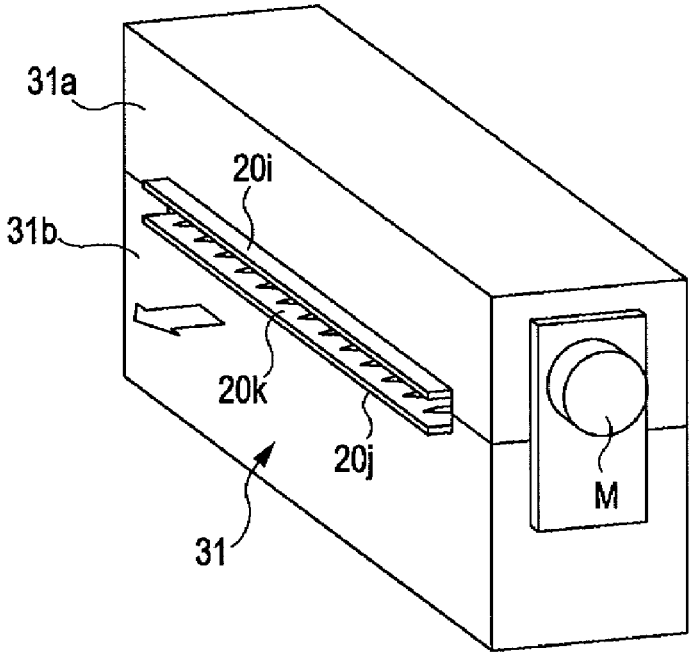
FIG. 2B is an external perspective view of the housing of the fixing device as seen from a recording-medium-discharge-opening side.
Figure 3:
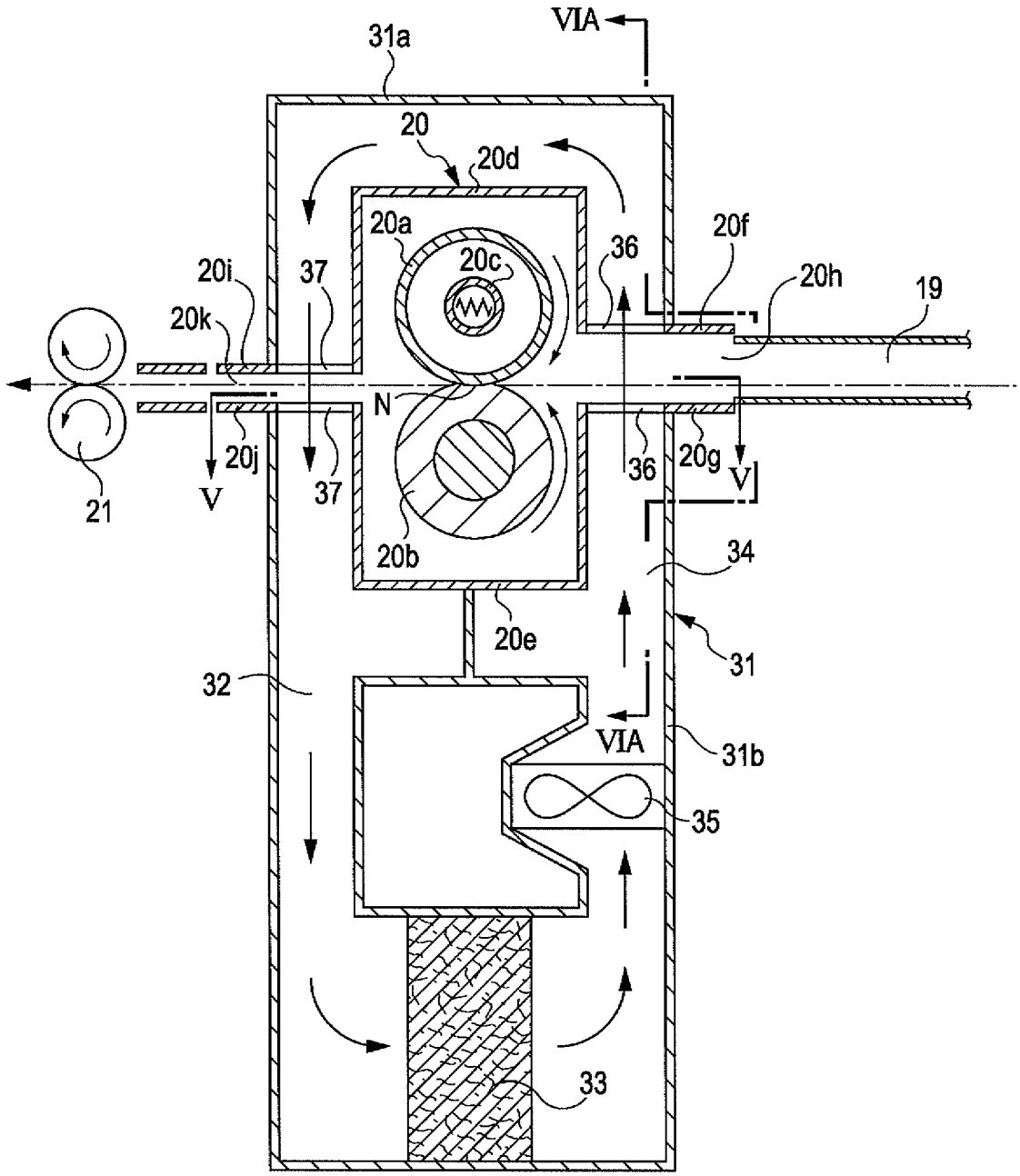
FIG. 3 is an enlarged transverse sectional view of the housing of the fixing device.
Figure 4:
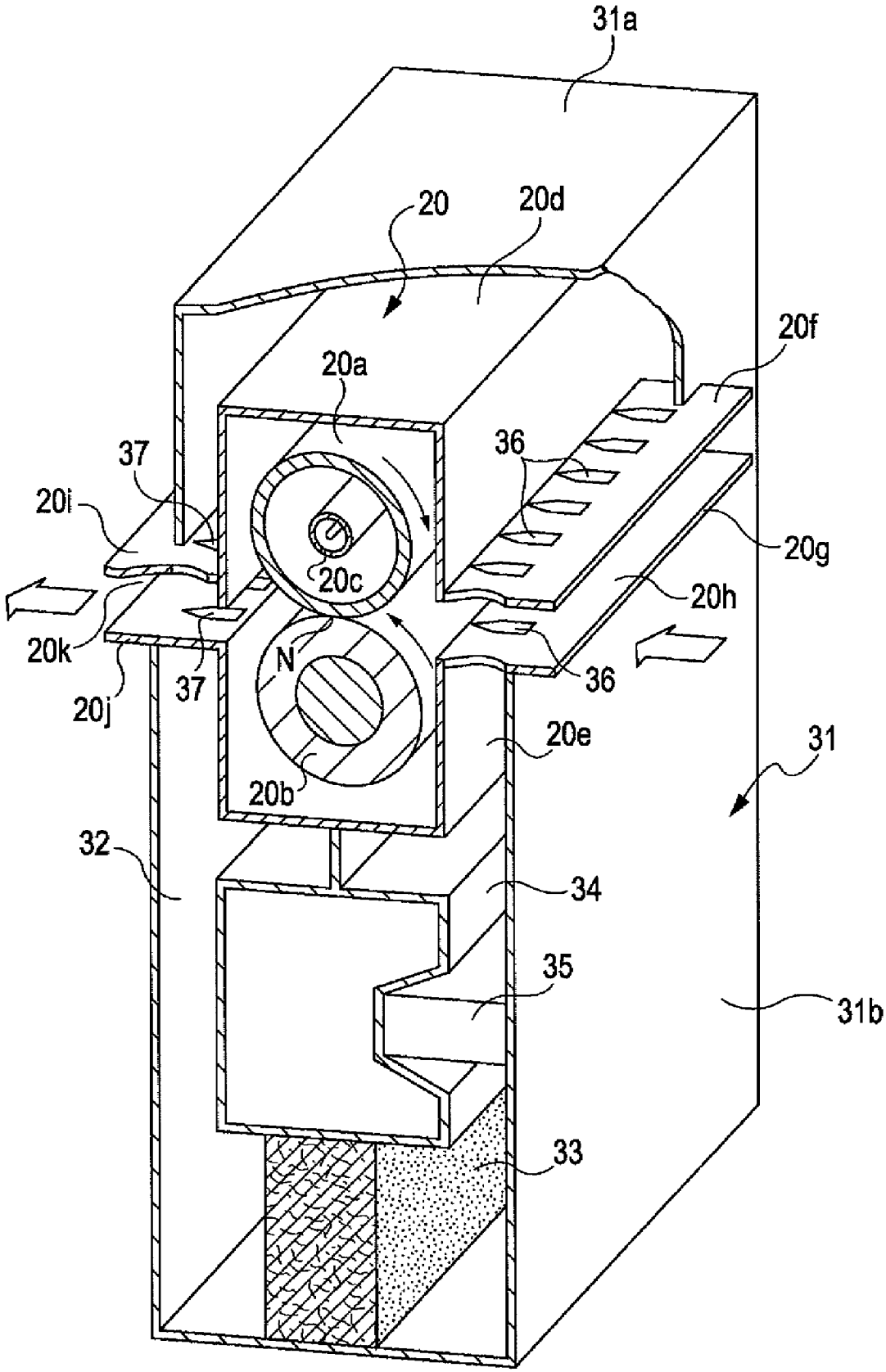
FIG. 4 is a perspective and broken view of the housing of the fixing device.
Figure 5:
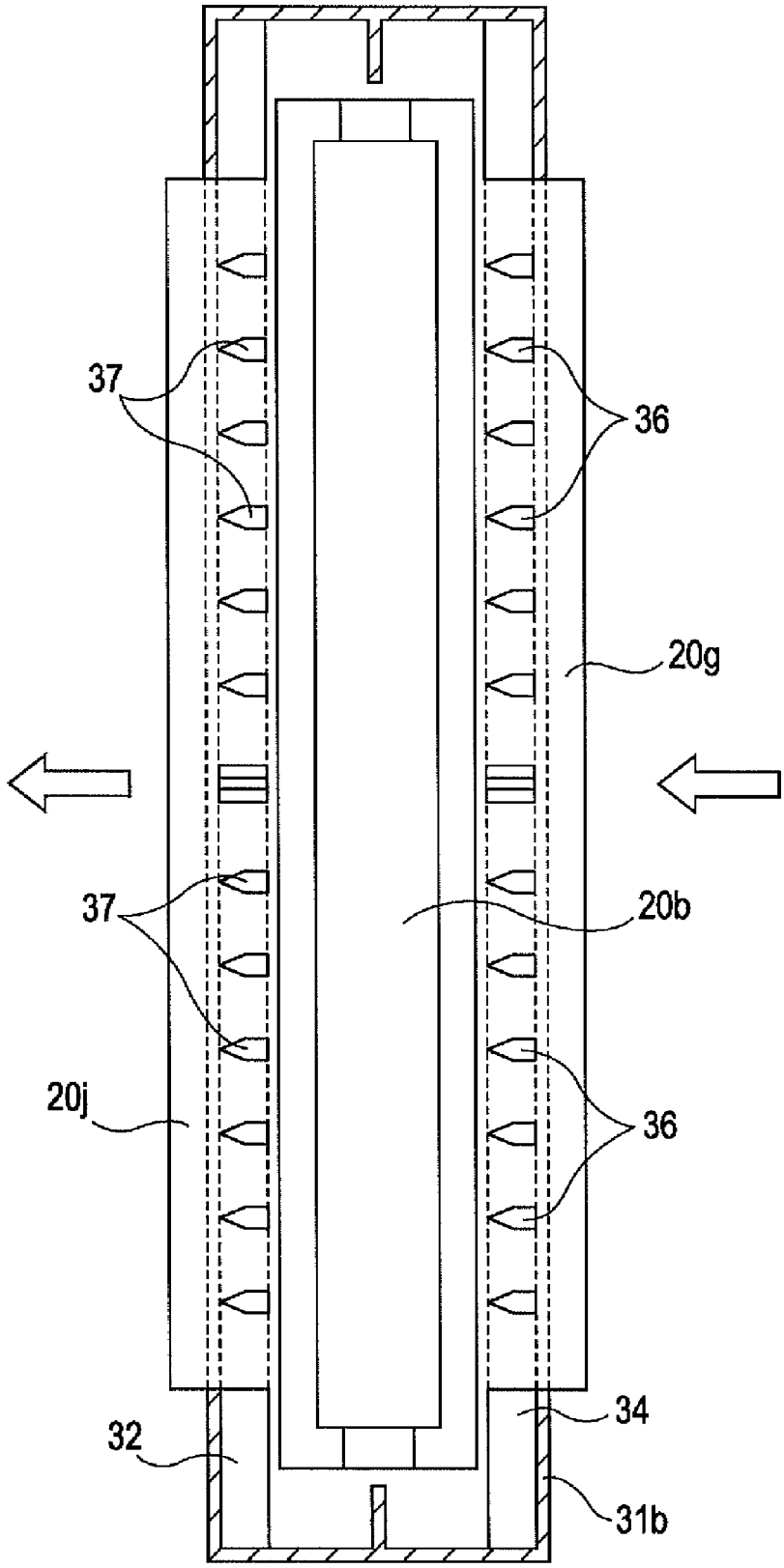
FIG. 5 is a plan view taken along line V-V of FIG. 3.
Figure 6A:
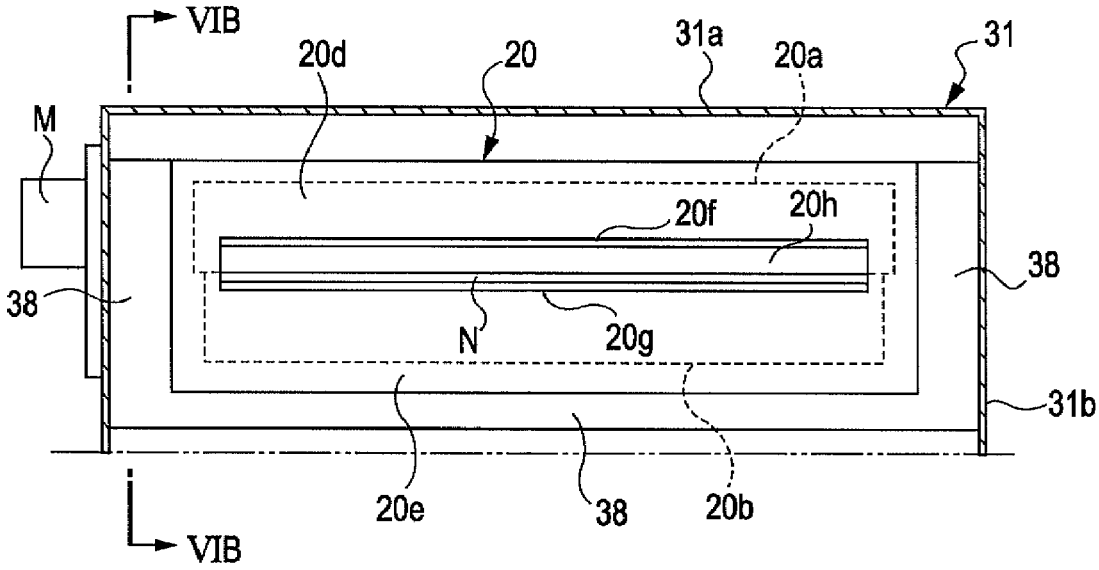
FIG. 6A is a sectional view taken along line VIA-VIA of FIG. 3.
Figure 6B:
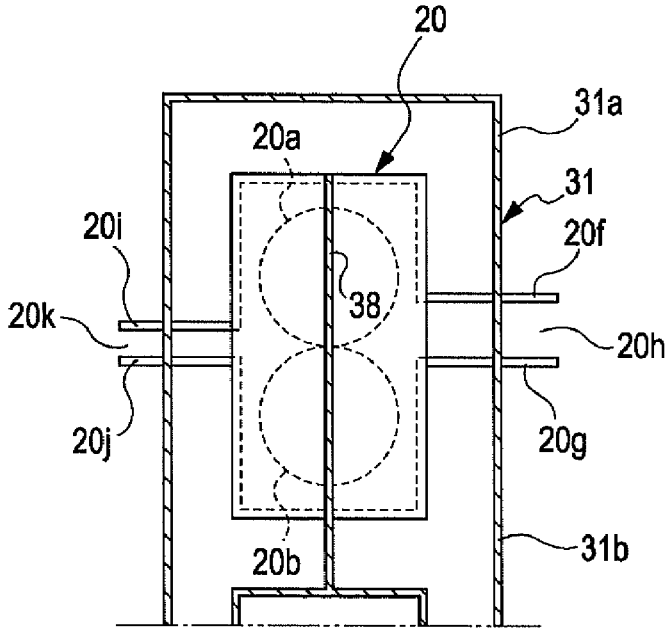
FIG. 6B is a sectional view taken along line VIB-VIB of FIG. 6A.

FIGS. 2A and 2B are external perspective views of the housing 31. FIG. 2A is the external perspective view of the housing 31 as seen from a recording-medium entering an opening 20*h* side. FIG. 2B is the external perspective view of the housing 31 as seen from a recording-medium discharge opening 20*k* side. FIG. 3 is an enlarged transverse sectional view of the housing 31. FIG. 4 is a perspective and broken view of the housing 31. FIG. 5 is a plan view taken along line V-V of FIG. 3. FIG. 6A is a sectional view taken along line VIA-VIA of FIG. 3. FIG. 6B is a sectional view taken along line VIB-VIB of FIG. 6A.

In the embodiment, the fixing device 20 is a thermal roller type. Symbols 20*a* and 20*b* denote a fixing roller and a pressure roller, respectively, where a fixing nip portion N is formed as a result of vertically arranging the rollers 20*a* and 20*b* in a row and press-contacting them to each other. The fixing roller 20*a* is formed by forming a release layer, such as a fluorocarbon resin layer, onto the outer peripheral surface of a hollow metallic roller formed of, for example, iron or aluminum and being a main body. A halogen heater 20*c* is provided as a heating source in the fixing device 20. The pressure roller 20*b* is a heat-resistant elastic roller having a rubber roller layer formed on a core bar. The fixing roller 20*a* and the pressure roller 20*b* are press-contacted to each other against the elasticity of the rubber roller layer to form the fixing nip portion N of a predetermined width in the direction in which a recording medium is transported. A motor M (shown in FIG. 2) rotationally drives the fixing roller 20*a* at a predetermined speed clockwise in the direction of the arrow shown in FIG. 3. The pressure roller 20*b* is rotated following the rotational driving of the fixing roller 20*a*.

Electric power is supplied to the halogen heater 20*c* from a power supply circuit (not shown). The heater 20*c* generates heat to heat the fixing roller 20*a* from the interior thereof. The surface temperature of the fixing roller 20*a* is monitored by a temperature sensor (not shown). Electrical information regarding a detected temperature is input to a controlling circuit (not shown). The controlling circuit controls the power supply to the heater 20*c* from the power supply circuit so as to regulate and maintain the surface temperature of the fixing roller 20*a* to a predetermined fixing temperature, on the basis of the input information.

Symbol 20*d* denotes a fixing-device upper cover that covers the fixing roller 20*a* side, and symbol 20*e* denotes a fixing-device lower cover that covers the pressure roller 20*b* side. At the upstream side of the fixing nip portion N in the recording-medium transportation direction, recording-medium guide path members 20*f* and 20*g* are extended so as to protrude outward from the upper cover 20*d* and the lower cover 20*e*, respectively, and so as to be disposed in a row vertically, thereby forming the recording-medium entering opening 20*h* of the fixing device 20. At the downstream side of the fixing nip portion N in the recording-medium transportation direction, recording-medium guide path members 20*i* and 20*j* are extended so as to protrude outward from the upper cover 20*d* and the lower cover 20*e*, respectively, and so as to be disposed in a row vertically, thereby forming the recording-medium discharge opening 20*k* of the fixing device 20.

The fixing roller 20*a* is rotationally driven, causing the pressure roller 20*b* to undergo coupled rotation. The temperature of the fixing roller 20*a* is regulated so as to be increased to the predetermined fixing temperature. In this state, the recording medium on which the unfixed toner images are formed at the secondary transfer nip portion T2 side passes through the after-transfer transportation path 19 and is introduced into the fixing device 20 from the recording-medium entering opening 20*h*. Then, the recording medium is nipped and transported by the fixing nip portion N, so that the recording medium is heated by the fixing roller 20*a* and pressed by the nipping. The multiple toner images of the four colors (yellow, magenta, cyan, and black) are fused and mixed to permanently fix the resulting toner image as a full-color print image to the surface of the recording medium P. The recording medium P that is nipped and transported by the fixing nip portion N moves out of the fixing device 20 from the recording-medium discharge opening 20*k* and is transported to the first sheet-discharge rollers 21, the sheet-discharge transportation path 22, the second sheet-discharge rollers 23, and the sheet-discharge opening 24, so that the recording medium P is discharged onto the sheet-discharge tray 25 disposed at the exterior portion of the image forming apparatus.

The housing 31 surrounds the fixing device 20, which is a component where the VOC gas is generated, in substantially hermetically sealed state excluding the recording-medium entering the opening 20*h* and the recording-medium discharge opening 20*k*, so that the housing 31 has a limited amount of space that includes the fixing device 20 and that is substantially enclosed. That is, air in an area of the housing including the fixing device 20 that is substantially hermetically sealed by the housing 31 is almost completely separated from air (airflow) outside the housing 31 so that they do not virtually mix with each other.

When the housing 31 is formed into the shape of a box by bending a sheet metal, for example, holes may be formed at corners represented by reference characters A in FIG. 2A. If the holes are small, a slight air leakage occurs, but creates no problem in circulating air in the housing 31 described later, so that this slight air leakage is allowable.

The housing 31 can be formed of a material that substantially does not generate VOC gas, and that has high thermal conductivity. A metallic material is suitable as such a material.

In the embodiment, the housing 31 includes an upper housing portion 31*a* that covers the upper cover 20*d* side and a lower housing portion 31*b* that covers the lower cover 20*e* side. The housing portions 31*a* and 31*b* are vertically combined. A space is formed between the outer side of the fixing device 20 and the inner side of the housing 31. This space constitutes the air circulation path in the housing that extends from a suction duct 32 to a filter 33 and to a re-suction duct 34 and back to the suction duct 32. A fan 35 is provided in the re-suction duct 34 to suitably circulate the air. A certain number of through holes 36 are provided in the recording-medium guide path members 20*f* and 20*g* (formed vertically at the recording-medium entering opening 20*h* of the fixing device 20) so as to allow the air to flow downward in the air circulation path in the housing 31. A certain number of through holes 37 are provided in the recording-medium guide path members 20*i* and 20*j* (formed vertically at the recording-medium discharge opening 20*k* of the fixing device 20) so as to allow the air to flow downward in the air circulation path in the housing 31.

Accordingly, air containing VOC gas that is generated from a recording medium when fixing images by the fixing device 20 or air containing VOC gas that is generated from a heat-resistant resinous member, including the fixing device itself, disposed in the vicinity of the housing 31 are in a substantially sealed state in only the housing 31. In addition, the air containing the VOC gas is sucked into the circulation of the air in the aforementioned structure. This causes the VOC gas that is not completely removed by passing it through the filter 33 only once to be removed by passing it through the filter 33 again and again.

According to the structure of the image forming apparatus, it is possible to complete the cleaning of the air (that is, the removal of the VOC gas) in the housing 31 that substantially hermetically seals only the fixing device 20 where the VOC gas is generated, that is, in the limited space that is substantially enclosed. In other words, it is possible to remove the VOC gas by a small limited structure that is provided only at the fixing device 20 where the VOC gas is generated. The independent air circulating system in the housing causes the air containing the VOC gas to repeatedly pass through and get absorbed by the filter 33. Therefore, the performance of the VOC-gas filter is optimally utilized to remove the VOC gas with high efficiency.

In the embodiment, the VOC-gas filter can be a filter that is formed of an activated carbon fiber and that sucks and decomposes the VOC gas. Ultrafine polypropylene can be used as the activated carbon fiber. In the embodiment, the VOC-gas filter can also be a filter having a pleated structure having excellent VOC-gas removal capability and having filter material arranged in a W shape.

In addition to the aforementioned examples of the VOC-gas filter, for example, an electrostatic filter or a honeycomb filter having excellent ventilation capability and space-saving capability may be used.

As shown in FIGS. 6A and 6B, in the substantially hermetically sealed space in the housing 31, with the fixing device 20 serving as an approximate center, a wall 38 is provided as a partition up to substantially the top end of the fixing device 20 to make it possible to circulate air with good efficiency.

The circulation of the air in the housing 31 may be performed only during an image forming operation in which the largest amount of VOC gas is generated. However, to remove a larger amount of the VOC gas, it is more efficient to also circulate the air during standby of the image forming apparatus.

In the case where, due to various limitations of the image forming apparatus, a problem occurs in the transportation of a recording medium P when air is circulated in the housing 31 during the passage of the recording medium P through the fixing device 20, the air circulation may be controlled so that it is performed only when the recording medium P is not passing through the fixing device 20.

In the embodiment, the housing 31 is cooled by air as a result of causing a temperature-rise preventing system to generate a flow of air outside the housing 31. In FIG. 1, a shaded portion represents an area outside the housing 31 where the air for preventing a temperature rise flows. In the embodiment, outside air is sucked from the front side of the body of the image forming apparatus, passes through the shaded portion in FIG. 1, and is discharged from the back side of the body of the image forming apparatus. Reference numeral 39 denotes a fan serving as a discharging unit disposed towards the back of the image forming apparatus.

If an electric component (such as the motor M that rotates the fixing roller 20*a*) that is mounted to the fixing device 20 creates a heat-resistance problem when it exists in the substantially hermetically sealed space in the housing 31, only such an electric component is disposed outside the housing 31 as shown in FIGS. 2A and 2B. That is, such an electric component protrudes outward from the housing 31 and is positioned where airflow generated by the temperature-rise preventing system occurs. This overcomes the aforementioned problem.

Although, in the embodiment, the direction of the circulation of air in the housing 31 is as indicated by the arrows in FIG. 3, the direction of the air circulation is not particularly limited. Therefore, even if the direction is opposite to that indicated by the arrows in FIG. 3, similar advantages are provided.

Figure 7:
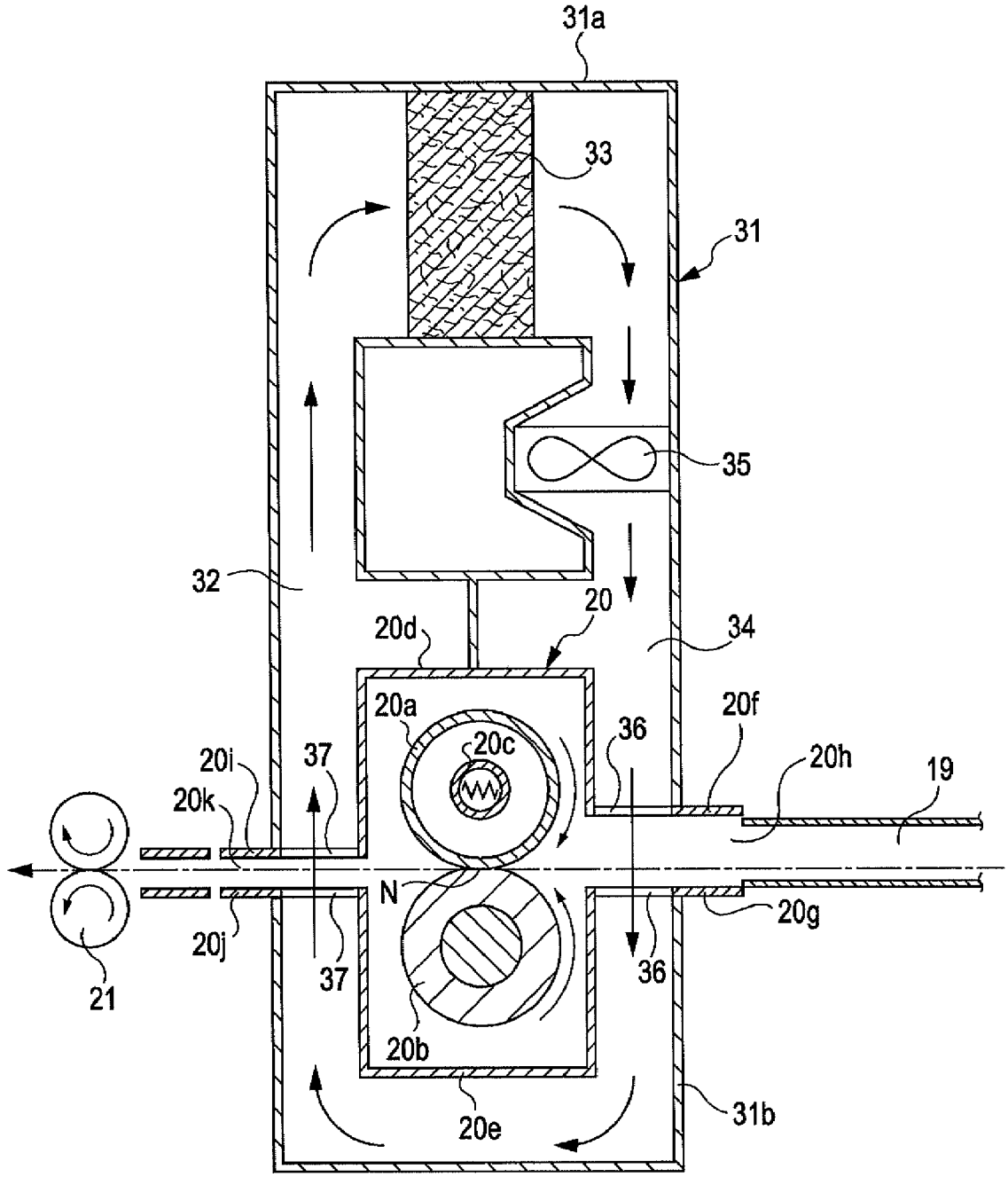
FIG. 7 shows a modification of FIG. 3.

Although, in the embodiment shown in FIGS. 1 to 6, the filter 33 and the fan 35 are disposed at the lower housing portion 31*b* side of the housing 31, they may be provided at the upper housing portion 31*a* side as shown in FIG. 7.

When the recording medium P that has the toner image fixed thereto by the fixing device 20 and that has moved out of the fixing device 20 is in a relatively high-temperature state tending to generate VOC gas and is discharged to the outside of the body of the image forming apparatus, the VOC-gas processing structure may be applied to the recording-medium transportation path between the fixing device 20 and the sheet-discharge opening.

In the embodiment, as shown in FIG. 1, the sheet-discharge transportation path 22, which is a portion in the image forming apparatus where VOC gas is generated, is covered by a housing 41 (serving as a hermetically sealing member) excluding portions of the sheet-discharge transportation path 22 where a recording medium moves into and out of the path 22, so that the sheet-discharge transportation path 22 is substantially hermetically sealed. In addition, air circulating means for circulating air in the housing 41 is provided. Further, a filter that absorbs VOC gas in the air is provided in an air-circulation path.

Figure 8:
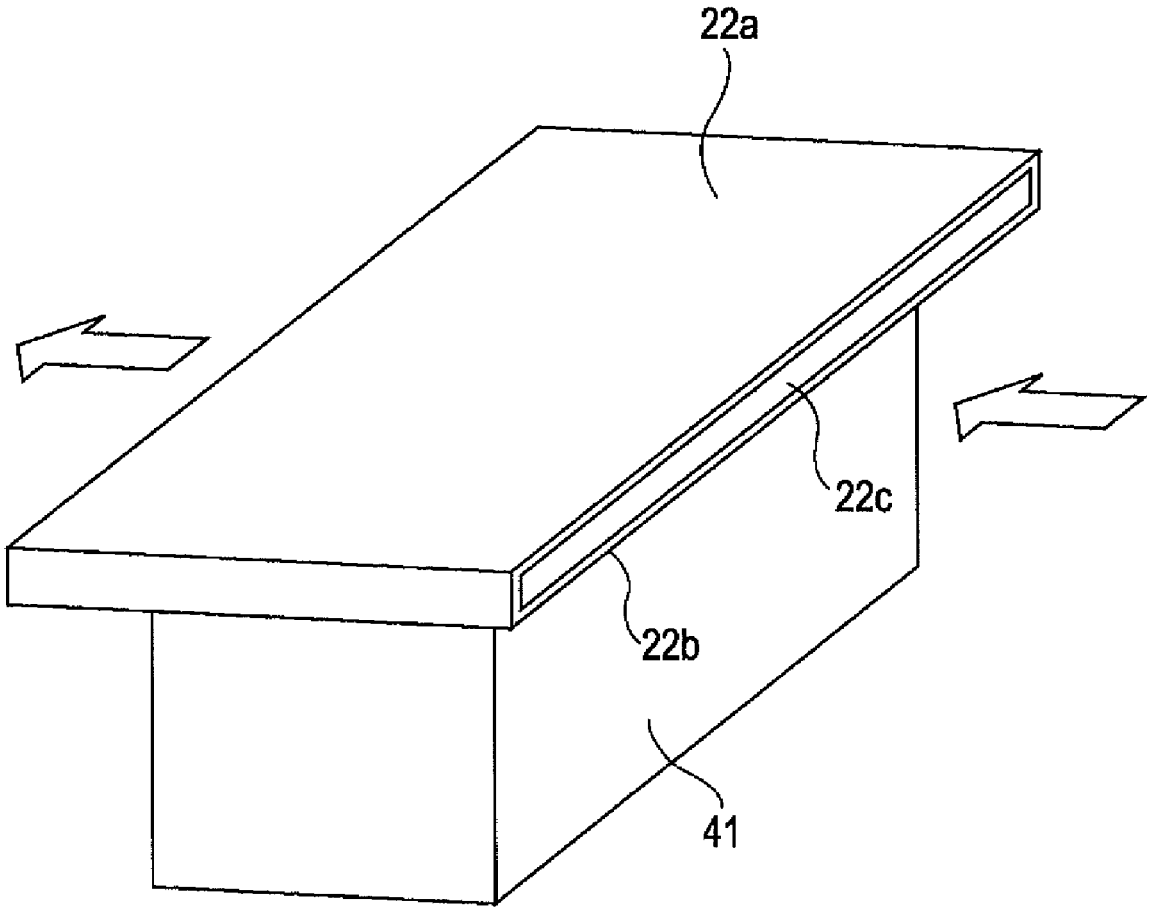
FIG. 8 is an external perspective view of a housing of a sheet-discharge transportation path as seen from a recording-medium-entering-opening side.
Figure 9:
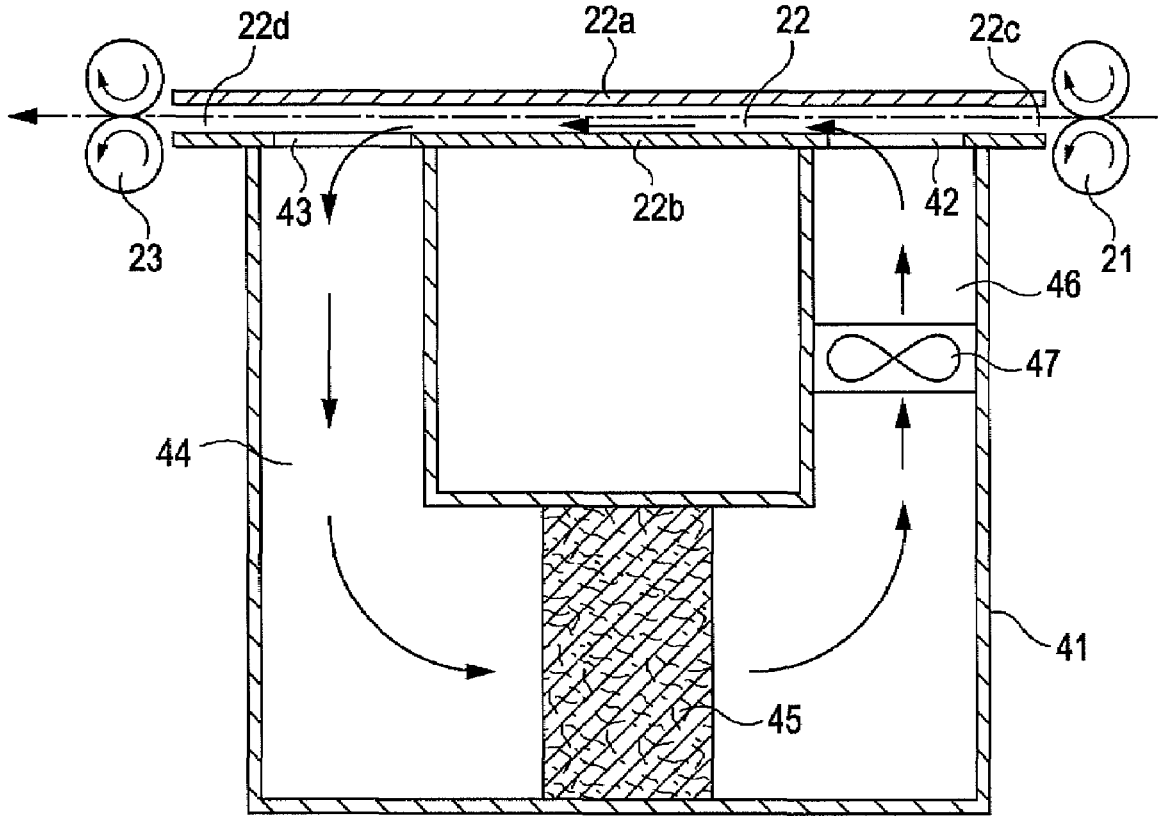
FIG. 9 is an enlarged transverse sectional view of the housing of the sheet-discharge transportation path.

FIG. 8 is an external perspective view of the housing 41 as seen from a recording-medium-entering-opening-22*c* side. FIG. 9 is an enlarged transverse sectional view of the housing 41.

Reference numerals 22*a* and 22*b* denote guide path members that define the sheet-discharge transportation path 22 and that are disposed vertically in a row. Reference numeral 22*c* denotes the upstream recording-medium entering opening of the sheet-discharge transportation path 22, and reference numeral 22*d* denotes a downstream recording-medium discharge opening of the sheet-discharge transportation path 22. The first sheet-discharge rollers 21 and the second sheet-discharge rollers 23 are disposed at the recording-medium entering opening 22*c* and the recording-medium discharge opening 22*d*, respectively. The box-shaped housing 41 is provided as a hermetically sealing member at the bottom of the lower guide path member 22*b*. The lower guide path member 22*b* has through holes 42 and 43 at the recording-medium entering opening 22*c* side and the recording-medium discharge opening 22*d* side, respectively, so that the sheet-discharge transportation path 22 communicates with the housing 41.

By virtue of the above-described structure, the sheet-discharge transportation path 22 is covered by the upper guide path member 22*a* and the housing 41 except at the recording-medium entering opening 22*c* and the recording-medium discharge opening 22*d*, so that the sheet-discharge transportation path 22 is substantially hermetically sealed. That is, air in the housing 41 and the sheet-discharge transportation path 22 that is substantially hermetically sealed by the upper guide path member 22*a* and the housing 41 is substantially completely separated from outside air (airflow) so that they do not substantially mix with each other.

An air circulation path is formed in the upper guide path member 22*a* and the housing 41 so as to extend to a suction duct 44, a filter 45, a re-suction duct 46, and the sheet-discharge transportation path 22, and back to the suction duct 44. To suitably circulate air, a fan 47 is provided in the re-suction duct 46.

The housing 41 and the guide path members 22*a* and 22*b* can be formed of a material that substantially does not generate VOC gas and that has high thermal conductivity. A metallic material is suitable as such a material.

A recording medium P that has moved out of the fixing device 20 is relayed by the first sheet-discharge rollers 21 and introduced into the sheet-discharge transportation path 22 from the recording-medium entering opening 22*c*. When the recording medium P passes through the sheet-discharge transportation path 22, the recording medium P contacts either the upper guide path member 22*a* or the lower guide path member 22*b*, so that the temperature of the recording medium P is reduced to a value that does not generate VOC gas. Then, the recording medium P moves out of the recording-medium discharge opening 22*d*, is relayed by the second sheet-discharge rollers 23, and is discharged onto the sheet discharge tray 25, disposed at the exterior portion of the image forming apparatus, from the sheet-discharge opening 24. In other words, the recording medium P is cooled in the sheet-discharge transportation path 22, to sufficiently reduce the amount of VOC that is generated, after which the recording medium P is discharged out of the image forming apparatus.

VOC-gas-containing air that has been discharged into the sheet-discharge path 22 from the recording medium P prior to the completion of the cooling of the recording medium P is sucked into the circulation of air in the above-described structure. Accordingly, the VOC gas that could not be completely removed by passing it through the filter 45 only once is passed through the filter 45 again and again, so that the VOC gas is removed with high efficiency. In addition, to more effectively remove the VOC gas, a portion of the air circulation path is used as a transportation path.

According to the above-described structure of the image forming apparatus, it is possible to complete the cleaning of the air (that is, the removable of VOC gas) in the housing 41 (covering the fixing device 22, where the VOC gas is generated, so as to substantially hermetically seal the fixing device 22), that is, in a limited space that is substantially enclosed. That is, it is possible to remove the gas by a small limited structure that is only provided at the component part where the VOC gas is generated. The air circulation system that is independently provided in the housing causes the VOC-gas-containing air to repeatedly pass through the filter 45 and to be absorbed by the filter 45. Therefore, when a generally provided VOC gas filter is used and its capability is optimally utilized, the VOC gas is removed at a low cost and with high efficiency.

In the case where, due to various limitations of the image forming apparatus, a problem occurs in the transportation of the recording medium P when the air is circulated during the passage of the recording medium P through the sheet-discharge transportation path 22, the air circulation may be controlled so that it is performed only when the recording medium P is not passing through the sheet-discharge transportation path 22.

As with the housing 31 surrounding the fixing device 20, the housing 41 and the upper guide path member 22*a* defining the sheet-discharge transportation path 22 are cooled by generating airflow outside the housing 41 as indicated by the shaded portion in FIG. 1.

Although, the direction of the circulation of air in the housing 41 and the upper guide path member 22*a* is as indicated by the arrows in FIG. 9, the direction of the air circulation is not particularly limited. Therefore, even if the direction is opposite to that indicated by the arrows in FIG. 9, similar advantages are provided.

Figure 10:
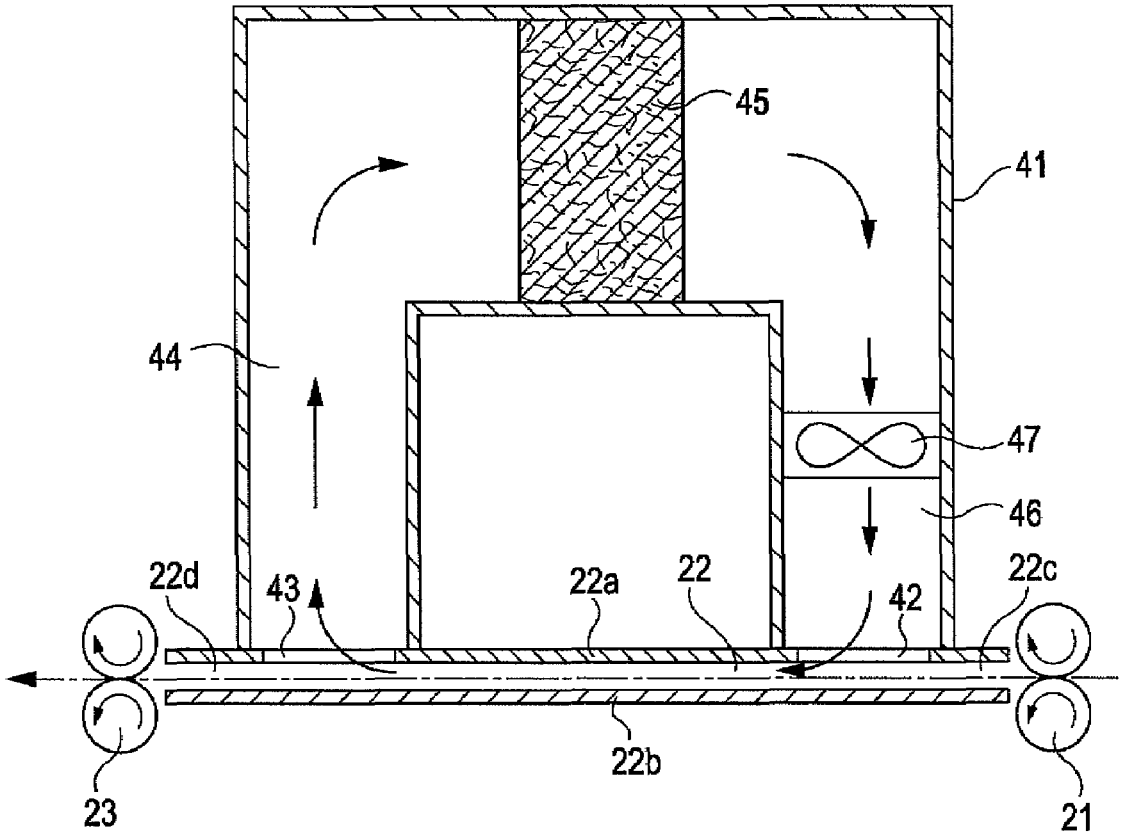
FIG. 10 is a modification of FIG. 9.

In the embodiment shown in FIGS. 1, 8, and 9, the housing 41 is provided at the bottom of the lower guide path member 22*b* defining the sheet-discharge transportation path 22 to dispose the filter 45 and the fan 47. However, as shown in FIG. 10, they may be provided above the lower guide path member 22*b*.

The structure according to the embodiment can remove VOC gas at a low cost and with high efficiency from the entire image forming apparatus. Therefore, as long as the filter 33 and the filter 45 are filters that are suitable for, for example, the locations where they are set in the image forming apparatus, and that can remove VOC gas, the filters that are usable are not particularly limited.

Although, in the foregoing description, the air circulation paths are formed by the housings and the fans, the air circulation paths are not limited thereto. For example, the air circulation path may be formed by providing a plurality of fans around the fixing device.

In addition, although, in the foregoing description, the fixing device is used as an example of the image heating unit, the present invention is not limited thereto. For example, the present invention is similarly applicable to a gloss increasing device that increases the gloss of a toner image by re-heating the toner image that has been already fixed to a recording medium by the fixing device.

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and functions.

This application claims the benefit of Japanese Application No. 2005-342043 filed Nov. 28, 2005, which is hereby incorporated by reference herein in its entirety.

What is claimed is:

1. An image forming apparatus comprising:

an image forming unit configured to form a toner image on a recording medium;

an image heating unit configured to heat the toner image on the recording medium;

a housing defining a substantially enclosed space so as to surround the image heating unit and allowing the recording medium to move into and out of the image heating unit;

an air circulating path defined in the housing and facilitating circulating air in the housing around the image heating unit;

a fan configured to circulate the air in the air circulating path; and a filter, disposed in the air circulating path, that removes a volatile organic substance in the air circulation path, wherein the fan circulates the air in the housing such that the air moves along the air circulating path and passes repeatedly through the filter to repeatedly remove the volatile organic substance in the air.

2. The image forming apparatus according to claim 1, further comprising at least one guide member provided so as to hang across the air circulation path and that guide the recording medium, and wherein the guide member have a plurality holes that allow passage of the air.

3. The image forming apparatus according to claim 1, wherein the housing is disposed inside an outer wall of the image forming apparatus.

4. The image forming apparatus according to claim 1, further comprising a discharging unit configured to discharge the air, introduced from outside the image forming apparatus, out of the image forming apparatus through the housing.

5. The image forming apparatus according to claim 4, further comprising a driving motor that drives the image heating unit, the driving motor being mounted outside the housing so as to be cooled by the discharging unit.

* * * * *